US007271343B2

(12) United States Patent
Clark

(10) Patent No.: US 7,271,343 B2
(45) **Date of Patent: *Sep. 18, 2007**

(54) SKEW ADJUSTED DATA CABLE

(75) Inventor: William T. Clark, Lancaster, MA (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/344,828

(22) Filed: Feb. 1, 2006

(65) Prior Publication Data

US 2006/0124342 A1 Jun. 15, 2006

Related U.S. Application Data

(63) Continuation of application No. 10/900,988, filed on Jul. 28, 2004, now Pat. No. 7,030,321.

(60) Provisional application No. 60/553,758, filed on Mar. 17, 2004, provisional application No. 60/490,651, filed on Jul. 28, 2003.

(51) Int. Cl.
*H01B 11/02* (2006.01)

(52) U.S. Cl. ..... 174/113 R

(58) Field of Classification Search ..... 174/113 R, 174/120 R, 121 A

See application file for complete search history.

(56) References Cited

U.S. PATENT DOCUMENTS

| | | | |
|---|---|---|---|
| 483,285 | A | 9/1892 | Guilleaume |
| 867,659 | A | 10/1907 | Hoopes et al. |
| 1,008,370 | A | 11/1911 | Robillot |
| 1,132,452 | A | 3/1915 | Davis |
| 1,700,606 | A | 1/1929 | Beaver |
| 1,883,269 | A | 10/1932 | Yonkers |
| 1,940,917 | A | 12/1933 | Okazaki |
| 1,976,847 | A | 10/1934 | Gordon et al. |
| 1,977,209 | A | 10/1934 | Sargent |
| 1,995,201 | A | 3/1935 | Delon |
| 2,218,830 | A | 10/1940 | Rose et al. |
| 2,501,457 | A | 3/1950 | Thelin |
| 2,538,019 | A | 1/1951 | Lee |
| 2,882,676 | A | 4/1959 | Bryan et al. |
| 3,055,967 | A | 9/1962 | Bondon |
| 3,328,510 | A | 6/1967 | White |
| 3,340,112 | A | 9/1967 | Davis et al. |
| 3,559,390 | A | 2/1971 | Staschewski |
| 3,603,715 | A | 9/1971 | Edhardt et al. |
| 3,622,683 | A | 11/1971 | Roberts et al. |
| 3,644,659 | A | 2/1972 | Campbell |
| 3,649,744 | A | 3/1972 | Coleman |

(Continued)

FOREIGN PATENT DOCUMENTS

| | | | |
|---|---|---|---|
| DE | 2555670 | A | 6/1997 |

(Continued)

*Primary Examiner*—Chau N. Nguyen
(74) *Attorney, Agent, or Firm*—Lowrie, Lando & Anastasi, LLP

(57) ABSTRACT

A twisted pair cable wherein characteristics of the twisted pairs, such as twist lay, insulation thickness, characteristic impedance, etc. are selected so as to achieve minimal skew between the twisted pairs. In some examples, insulation materials may be varied among the twisted pairs and composite insulations may be used for one or more pairs in a cable.

11 Claims, 11 Drawing Sheets

U.S. PATENT DOCUMENTS 3,819,443 A 6/1974 Simons et al.
3,881,052 A 4/1975 Britz et al.
3,911,200 A 10/1975 Simons et al.
4,034,148 A 7/1977 Lang
4,319,940 A 3/1982 Arroyo et al.
4,487,992 A 12/1984 Tomita
4,500,748 A 2/1985 Klein
4,595,793 A 6/1986 Arroyo et al.
4,605,818 A 8/1986 Arroyo et al.
4,644,098 A 2/1987 Norris
4,647,714 A 3/1987 Goto
4,654,476 A 3/1987 Barnicol-Ottler et al.
4,697,051 A 9/1987 Beggs et al.
4,710,594 A 12/1987 Walling et al.
4,767,891 A 8/1988 Biegon et al.
4,777,325 A 10/1988 Siwinski
4,778,246 A 10/1988 Carroll
4,784,462 A 11/1988 Priaroggia
4,788,088 A 11/1988 Kohl
4,800,236 A 1/1989 Lemke
4,828,352 A 5/1989 Kraft
4,847,443 A 7/1989 Basconi
4,866,212 A 9/1989 Ingram
4,892,683 A 1/1990 Naseem
4,912,283 A 3/1990 O'Connor
4,970,352 A 11/1990 Satoh
4,987,394 A 1/1991 Harman et al.
5,010,210 A 4/1991 Sidi et al.
5,015,800 A 5/1991 Vaupotic et al.
5,037,999 A 8/1991 Van Deusen
5,043,530 A 8/1991 Davies
5,068,497 A 11/1991 Krieger
5,073,682 A 12/1991 Walling et al.
5,077,449 A 12/1991 Cornibert et al.
5,097,099 A 3/1992 Miller
5,107,076 A 4/1992 Bullock et al.
5,132,488 A 7/1992 Tessier et al.
5,132,490 A 7/1992 Aldissi
5,132,491 A 7/1992 Mulrooney
5,142,100 A 8/1992 Vaupotic
5,146,048 A 9/1992 Yutori et al.
5,149,915 A 9/1992 Brunker et al.
5,155,304 A 10/1992 Gossett et al.
5,170,010 A 12/1992 Aldissi
5,173,961 A 12/1992 Chiasson
5,177,809 A 1/1993 Zeidler
5,180,890 A 1/1993 Pendergrass
5,206,485 A 4/1993 Srubas et al.
5,212,350 A 5/1993 Gebs
5,216,202 A 6/1993 Yoshida et al.
5,220,130 A 6/1993 Walters
5,222,177 A 6/1993 Chu et al.
5,245,134 A 9/1993 Vana, Jr. et al.
5,253,317 A 10/1993 Allen et al.
5,254,188 A 10/1993 Blew
5,298,680 A 3/1994 Kenny
5,304,739 A 4/1994 Klug et al.
5,313,020 A 5/1994 Sackett
5,371,484 A 12/1994 Nixon
5,393,933 A 2/1995 Goertz
5,399,813 A 3/1995 McNeill et al.
5,418,878 A 5/1995 Sass et al.
5,424,491 A 6/1995 Walling et al.
5,493,071 A 2/1996 Newmoyer
5,514,837 A 5/1996 Kenny et al.
5,541,361 A 7/1996 Friesen et al.
5,544,270 A 8/1996 Clark et al.
5,574,250 A 11/1996 Hardie et al.
5,576,515 A 11/1996 Bleich et al.
5,658,406 A 8/1997 Walling et al.
5,666,452 A 9/1997 Deitz, Sr. et al.
5,699,467 A 12/1997 Kojima et al.
5,744,757 A 4/1998 Kenny et al.
5,767,441 A 6/1998 Brorein et al.
5,789,711 A 8/1998 Gaeris et al.
5,814,768 A 9/1998 Wessels et al.
5,821,466 A 10/1998 Clark et al.
5,821,467 A 10/1998 O'Brien et al.
5,834,697 A 11/1998 Baker et al.
5,841,072 A * 11/1998 Gagnon ..... 174/110 F
5,841,073 A 11/1998 Randa et al.
5,883,334 A 3/1999 Newmoyer et al.
5,888,100 A 3/1999 Bofill et al.
5,900,588 A 5/1999 Springer et al.
5,920,672 A 7/1999 White
5,936,205 A 8/1999 Newmoyer
5,952,607 A 9/1999 Friesen et al.
5,952,615 A 9/1999 Prudhon
5,956,445 A 9/1999 Deitz, Sr. et al.
5,969,295 A 10/1999 Boucino et al.
5,990,419 A 11/1999 Bogese, II
6,037,546 A 3/2000 Mottine et al.
6,074,503 A 6/2000 Clark et al.
6,091,025 A 7/2000 Cotter et al.
6,150,612 A 11/2000 Grandy et al.
6,153,826 A 11/2000 Kenny et al.
6,162,992 A 12/2000 Clark et al.
6,194,663 B1 2/2001 Friesen et al.
6,248,954 B1 6/2001 Clark et al.
6,255,593 B1 7/2001 Reede
6,272,828 B1 8/2001 Walling et al.
6,273,977 B1 8/2001 Harden et al.
6,288,340 B1 9/2001 Arnould
6,300,573 B1 10/2001 Horie et al.
6,303,867 B1 10/2001 Clark et al.
6,323,427 B1 11/2001 Rutledge
6,353,177 B1 3/2002 Young
6,355,876 B1 3/2002 Morimoto
6,403,887 B1 6/2002 Kebabjian et al.
6,441,308 B1 8/2002 Gagnon
6,462,268 B1 10/2002 Hazy et al.
6,566,607 B1 5/2003 Walling
6,570,095 B2 5/2003 Clark et al.
6,596,944 B1 7/2003 Clark et al.
6,770,819 B2 8/2004 Patel
6,789,311 B2 9/2004 Fidi et al.
7,030,321 B2 * 4/2006 Clark ..... 174/113 R
2005/0087361 A1 4/2005 Hayes et al.
2006/0059883 A1 3/2006 Hopkinson et al.

FOREIGN PATENT DOCUMENTS

EP 1296336 A1 8/2002
GB 361930 11/1931
GB 486970 6/1938
JP 5159628 A 6/1993
WO 9634400 A1 10/1996
WO WO 2005/041219 A1 5/2005

* cited by examiner

SKEW ADJUSTED DATA CABLE

RELATED APPLICATIONS

This application is a continuation of and claims the benefit under 35 U.S.C. § 120 to pending U.S. patent application Ser. No. 10/900,988, entitled "SKEW ADJUSTED DATA CABLE," filed on Jul. 28, 2004 now U.S. Pat. No. 7,030,321, which claims priority under 35 U.S.C. § 119(e) to U.S. Provisional Application Ser. No. 60/490,651, entitled "LOW-SKEW, HIGH SPEED DATA CABLE," filed on Jul. 28, 2003, and U.S. Provisional Application Ser. No. 60/553,758, entitled "SKEW ADJUSTED DATA CABLE," filed on Mar. 17, 2004, all of which are herein incorporated by reference in their entireties.

BACKGROUND OF INVENTION

1. Field of Invention

The present invention is directed to twisted pair cables, particularly those having twist lays, insulation thicknesses, insulation materials, and performance variables, such as characteristic impedance, that are optimized to achieve low skew.

2. Discussion of Related Art

High performance electrical cables are often used to transmit electrical signals between devices or components of a network. These cables typically include several pairs of insulated conductors twisted together, generally in a double-helix pattern about a longitudinal axis. Such an arrangement of insulated conductors, referred to herein as "twisted pairs," facilitates forming a balanced transmission line for data communications. One or more twisted pairs may subsequently be bundled and/or bound together to form a data communication cable.

Modern communication cables must meet electrical performance characteristics required for transmission at high frequencies. The Telecommunications Industry Association and the Electronics Industry Association (TIA/EIA) have developed standards which specify specific categories of performance for cable impedance, attenuation, skew and crosstalk isolation. For example, one standard for crosstalk or, in particular, crosstalk isolation, is TIA/EIA-568-A, wherein a category 5 cable is required to have 38 dB of isolation between the twisted pairs at 100 MHz and a category 6 cable is required to have 42 dB of isolation between the twisted pairs at 100 MHz. Various cable design techniques have been used to date in order to try to reduce crosstalk and to attempt to meet the industry standards. In addition, if cables are to be used in plenum, they must pass the Underwriter's Laboratory Standard 910 test, commonly referred to as the Steiner Tunnel test.

These specifications and requirements limit the selection of insulation materials that may be used in communication cables. Preferred insulation materials have been fluoropolymers because these materials provide certain desirable electronic characteristics, such as low signal attenuation and reduced signal phase delay. In addition, communication cables having insulation materials formed from fluoropolymers can pass the Steiner Tunnel test. Examples of fluoropolymer insulation materials used in communication cables include fluoroethylenepropylene (FEP), ethylenechlorotrifluoroethylene (ECTFE), polyvinylidene fluoride (PVDF) and polytetrafluoroethylene (PTFE).

However, fluoropolymer insulation materials also have disadvantages such as relatively high cost and limited availability caused by the high demand for these materials.

Therefore, several communication cables have been developed that replace some of the fluoropolymer insulation materials with certain non-fluoropolymer insulation materials. For example, U.S. Pat. No. 5,841,072 to Gagnon, herein incorporated by reference, discloses a twisted pair cable wherein each conductor of the twisted pair has a dual-layer insulation, the first (inner) layer being a foamed polyolefin including a flame retardant and the second (outer) layer being a fluoropolymer. In another example, a cable construction may comprise a mix of conductors, for example, with some conductors of the cable insulated with a single layer of fluoropolymer materials and others conductors in the same cable insulated with a single layer of polyolefin materials.

It is known that as the dielectric constant of an insulation material covering the conductors of a twisted pair decreases, the velocity of propagation of a signal traveling through the twisted pair of conductors increases and the phase delay added to the signal as it travels through the twisted pair decreases. In other words, the velocity of propagation of the signal through the twisted pair of conductors is inversely proportional to the dielectric constant of the insulation material and the added phase delay is proportional to the dielectric constant of the insulation material. Thus, using different insulation materials among conductor pairs within a cable may cause a variation in the phase delay added to the signals propagating through different ones of the conductors pairs. It is to be appreciated that for this specification the term "skew" is a difference in a phase delay added to the electrical signal for each of the plurality of twisted pairs of the communication cable. A skew may result from the insulation material covering one twisted pair of conductors being different than the insulation material covering another twisted pair of conductors of a communication cable.

In addition, in order to impedance match a cable to a load (e.g., a network component), a cable may be rated with a particular "characteristic impedance." For example, many radio frequency (RF) components may have characteristic impedances of 50 or 100 Ohms and therefore, many high frequency cables may similarly be manufactured with a characteristic impedance of 50 or 100 Ohms so as to facilitate connecting of different RF loads. The characteristic impedance of the cable may generally be determined based on a composite of the individual nominal impedances of each of the twisted pairs making up the cable. The nominal impedance of a twisted pair may be related to several parameters including the diameter of the wires of the twisted pairs making up the cable, the center-to-center distance between the conductors of the twisted pairs, which may in turn depend on the thickness of the insulating layers surrounding the wires, and the dielectric constant of the material used to form the insulating layers.

In conventional manufacturing, it is generally considered more beneficial to design and manufacture twisted pairs to achieve as close to the specified characteristic impedance of the cable as possible, generally within plus or minus 2 Ohms. The primary reason for this is to take into account impedance variations that may occur during manufacture of the twisted pairs and the cable. The further away from the specified characteristic impedance a particular twisted pair is, the more likely a momentary deviation from the specified characteristic impedance the input impedance of at any particular frequency due to impedance roughness will exceed limits for both input impedance and return loss of the cable.

Many of the same parameters of a twisted pair affect both the characteristic impedance and the skew of a twisted pair cable. Therefore, there needs to be a balance or trade-off created between these parameters for the cable to meet all specified performance requirements, such as return loss, skew and crosstalk.

SUMMARY OF INVENTION

According to one embodiment, a cable comprises a first twisted pair of conductors surrounded by a first insulation material having a first dielectric constant, the first twisted pair of conductors having a first signal phase delay, and a second twisted pair of conductors insulated by a second insulation material having a second dielectric constant greater than the first dielectric constant, the second twisted pair of conductors having a second signal phase delay substantially equal to the first signal phase delay such that a skew of the cable is less than approximately 7 nanoseconds per 100 meters. The first twisted pair of conductors has a first twist lay and the second twisted pair of conductors has a second twist lay greater than the first twist lay, and the second insulation material comprises a first layer having a third dielectric constant and a second layer having a fourth dielectric constant such that the second dielectric constant is an effective dielectric constant of a combination the first and second layers.

According to another embodiment, a cable comprises a first twisted pair of conductors insulated by a first insulation material having a first dielectric constant, the first twisted pair of conductors having a first signal phase delay, and a second twisted pair of conductors insulated by a second insulation material having a second dielectric constant greater than the first dielectric constant, the second twisted pair of conductors having a second signal phase delay substantially equal to the first signal phase delay such that a skew of the cable is less than approximately 7 nanoseconds per 100 meters. The first twisted pair of conductors has a first twist lay and the second twisted pair of conductors has a second twist lay greater than the first twist lay, and the first insulation is a composite formed of at least two different materials.

Another embodiment of a cable having a specified characteristic impedance comprises a plurality of twisted pairs of insulated conductors designated into a first group of twisted pairs and a second group of twisted pairs, wherein each twisted pair designated into the first group of twisted pairs has a first twist lay, a first insulation thickness and a first nominal impedance, wherein each twisted pair designated into the second group of twisted pairs has a second twist lay, a second insulation thickness and a second nominal impedance, and wherein a first combination of the first twist lay and the first insulation thickness, and a second combination of the second twist lay and the second insulation thickness are selected such that a difference between the first nominal impedance and the second nominal impedance is greater than about 2 Ohms and less than about 15 Ohms, and the cable has a skew of less than approximately 25 ns per 100 m.

In one example of the cable, each of the plurality of twisted pairs has a same insulation material. In another example, the first and second combinations are selected such that an impedance delta between the first nominal impedance and the second nominal impedance is in a range of about 8 Ohms to 15 Ohms.

According to another embodiment, there is provided a method of manufacturing a cable comprising a plurality of twisted pairs of insulated conductors that are designated into two groups wherein each twisted pair designated into the first group of twisted pairs has a first twist lay, a first insulation material and a first insulation thickness and wherein each twisted pair designated into the second group of twisted pairs has a second twist lay, a second insulation material and a second insulation thickness, the method comprising steps of selecting a combination of the first twist lay, the first insulation material and the first insulation thickness such that the twisted pairs designated into the first group have a first nominal impedance, and selecting a combination of the second twist lay, the second insulation material and the second insulation thickness such that the twisted pairs designated into the second group have a second nominal impedance that is at least 2 Ohms greater than the first nominal impedance and such that a skew between the twisted pairs of the first group and the twisted pairs of the second group is less than about 25 ns per 100 m.

In one example, the act of selecting the combination of the second twist lay, the second insulation material and the second insulation thickness includes selecting the combination such that a delta between the second nominal impedance and the first nominal impedance is in a range of about 8 Ohms to 15 Ohms.

BRIEF DESCRIPTION OF DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
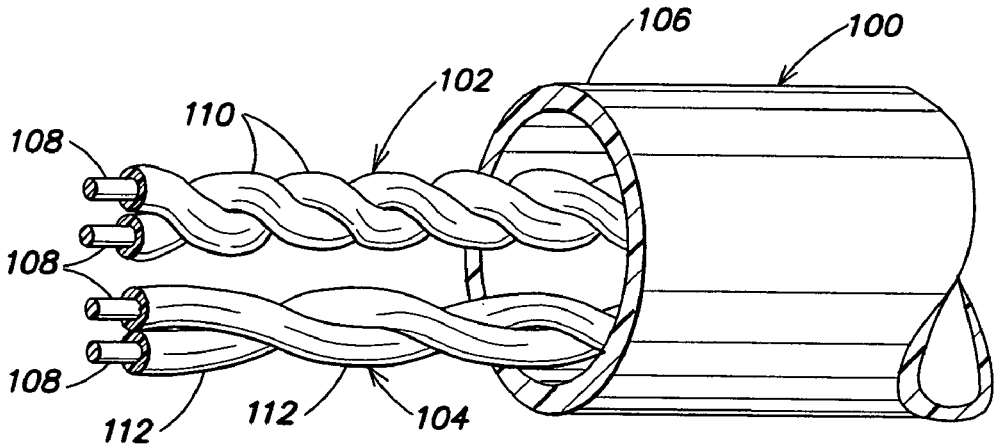
FIG. 1 (Related Art)
FIG. 1 is a perspective view of a cable including two twisted pairs having different twist lay lengths.

Various embodiments of the invention are described in detail below with reference to the accompanying figures. However, it is to be appreciated that the invention is not limited to any number of twisted pairs or any profile for the cables illustrated in any of these embodiments. The inventive principles can be applied to cables including greater or fewer numbers of twisted pairs and having different core profiles. In addition, the invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

According to one embodiment, a cable 100 may comprise a plurality of twisted pairs of insulated conductors including a first twisted pair 102 and a second twisted pair 104, surrounded by an outer jacket 106, as illustrated in FIG. 1. The outer jacket 106 may be any suitable jacket material, including, for example, a polyvinylchloride (PVC), a low-smoke, low-flame PVC, or any plenum or non-plenum rated thermoplastic. Each twisted pair of the plurality of twisted pairs has a specified distance between twists along the longitudinal direction, that distance being referred to as the pair twist lay. When adjacent twisted pairs have the same twist lay and/or twist direction, they tend to lie within a cable more closely spaced than when they have different twist lays and/or twist direction. Such close spacing increases the amount of undesirable crosstalk which occurs between the adjacent pairs. Therefore, each twisted pair within the cable 100 may have a unique pair lay in order to increase the spacing between pairs and thereby to reduce the crosstalk between the twisted pairs of the cable. Twist direction may also be varied.

Referring to FIG. 1, the first twisted pair of conductors 102 includes two electrical conductors 108 each surrounded by an insulation layer 110 of a first insulation material. The second twisted pair of conductors 104 also includes two electrical conductors 108 each surrounded by an insulation layer 112. As shown in FIG. 1, the twisted pairs 102, 104 may have different twist lay lengths to reduce unwanted crosstalk between the pairs. However, the shorter a given pair's twist lay length, the longer the "untwisted length" of that pair and thus the greater the signal phase delay added to an electrical signal that propagates through the twisted pair. It is to be understood that the term "untwisted length" herein denotes the electrical length of the twisted pair of conductors when the twisted pair of conductors has no twist lay (i.e., when the twisted pair of conductors is untwisted). Therefore, using different twist lays among the twisted pairs within a cable may cause a variation in the phase delay added to the signals propagating through different ones of the conductors pairs.

As discussed above, both the insulation material used for the insulated conductors and the twist lay used for each twisted pair may affect the propagation velocity of electrical signals through the twisted pairs. In order to reduce crosstalk between pairs, it may be desirable to vary the twist lays of the twisted pairs 102, 104. However, this may result in the twisted pairs 102, 104 having different electrical lengths, causing a skew to exist within the cable 100. The present invention is directed to several configurations of cables using varying twist lays and insulation materials optimized to achieve closely matched signal velocities relative to the final twist lays of the cable to minimize skew within the cable.

As discussed above, the propagation velocity of a signal through a twisted pair of insulated conductors is affected by the dielectric constant of the insulating material used for that twisted pair. For example, using a so-called "faster" insulation, such as fluoroethylenepropylene (FEP), the propagation velocity of a signal through the twisted pair 102 may be approximately 0.69 c (where c is the speed of light in a vacuum). For a "slower" insulation, such as polyethylene, the propagation velocity of a signal through the twisted pair 102 may be approximately 0.66 c.

According to one embodiment, the second twisted pair 104 may have a longer twist lay length than does the first twisted pair 102, as shown in FIG. 1. A shorter twist lay for a first twisted pair of insulated conductors relative to a second twisted pair results in the first twisted pair having a longer electrical length than the second twisted pair, assuming the first and second twisted pairs have a similar insulation material on the insulated conductors. Therefore, by using a higher dielectric constant material (slower insulation) for the second twisted pair (which has a shorter electrical length due to its longer twist lay) relative to the first twisted pair, the phase delay added to the electrical signals propagating through the first and second twisted pairs may be equalized. In this manner, the skew between the first and second twisted pairs may be minimized.

Thus, the second twisted pair 104 may have the second insulation layers 112 comprising a second insulation material that has a higher dielectric constant than the first insulation material. For example, the first insulation layer 110 may comprise FEP and the second insulation layer 112 may comprise polyethylene. Compensating for the higher signal phase delay provided by the twisted pair 104 (due to the higher dielectric constant of the insulation layer 112) relative to the twisted pair 102, the untwisted length of the twisted pair 102 can be increased compared to the untwisted length of the twisted pair 104. Thus, by controlling the twist lay lengths of twisted pairs 102 and 104 relative to one another and by selecting insulation materials having different dielectric constants for the insulation layers 110, 112, the signal phase delay added to the signal by the twisted pair 102 can be manipulated to be similar to the signal phase delay added to the signal propagating through the twisted pair 104.

The effective dielectric constant of an insulation material may also depend, at least in part, on the thickness of the insulating layer. This is because the effective dielectric constant may be a composite of the dielectric constant of the insulating material itself in combination with the surrounding air. Therefore, the propagation velocity of a signal through a twisted pair may depend not only on the twist lay and insulation material used, but also on the thickness of the insulation of that twisted pair.

Figure 2:
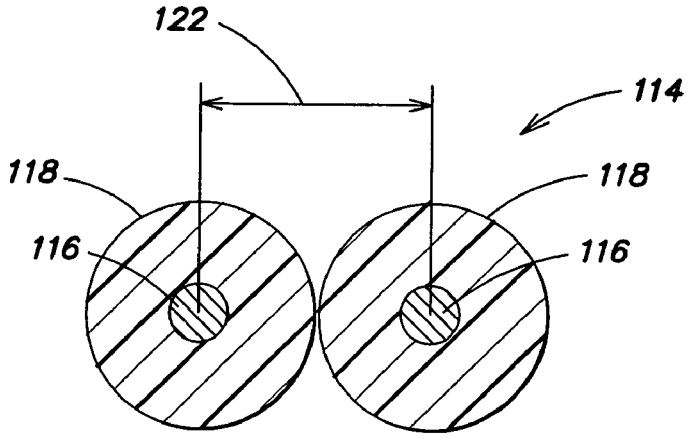
FIG. 2 is a schematic cross-sectional diagram of a twisted pair of insulated conductors.
Figure 3A:
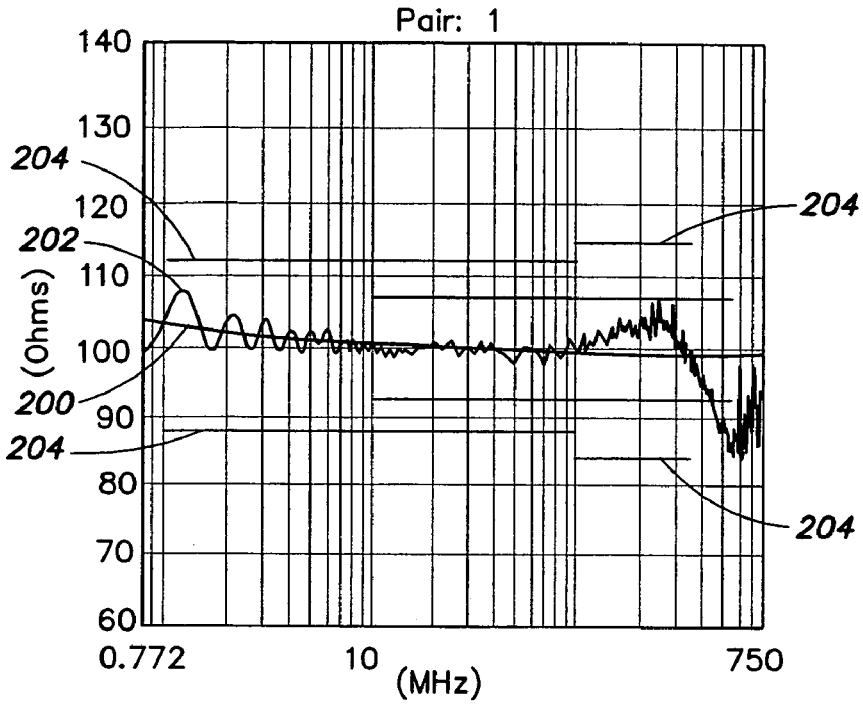
FIGS. 3A-3D are graphs illustrating impedance versus frequency for twisted pairs of one embodiment of a cable.
Figure 3B:
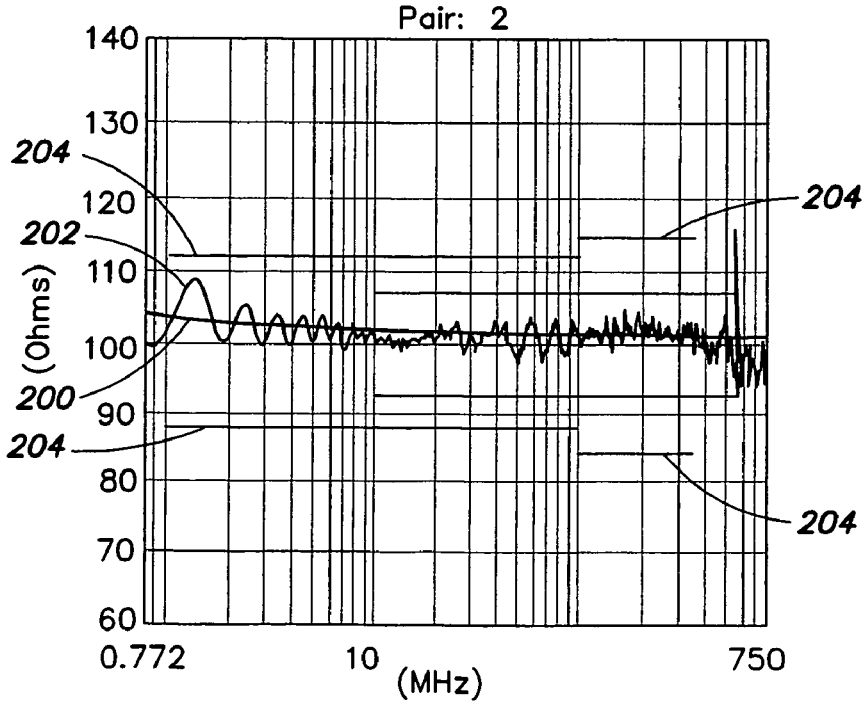
Figure 3C:
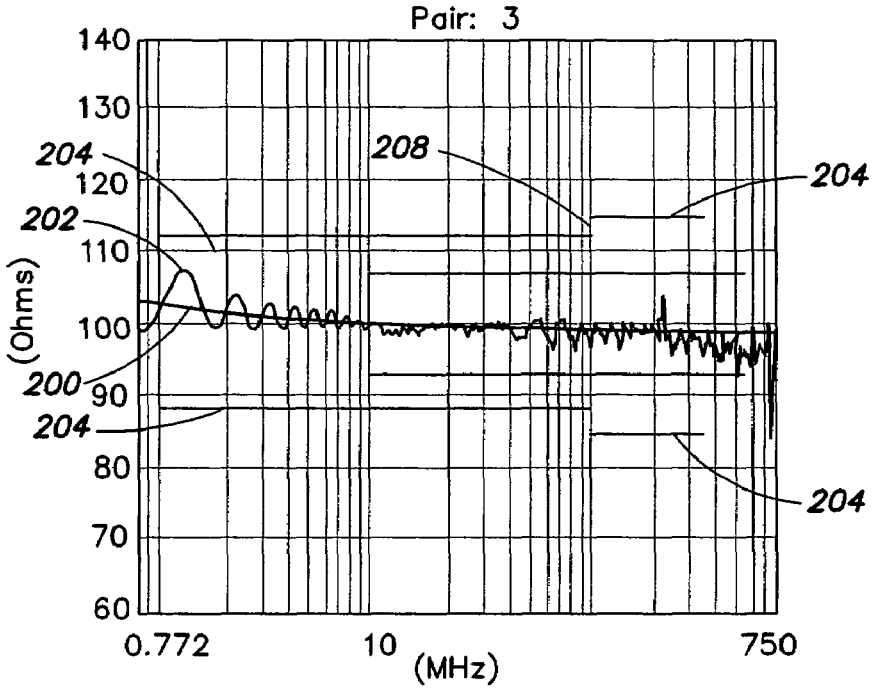
Figure 3D:
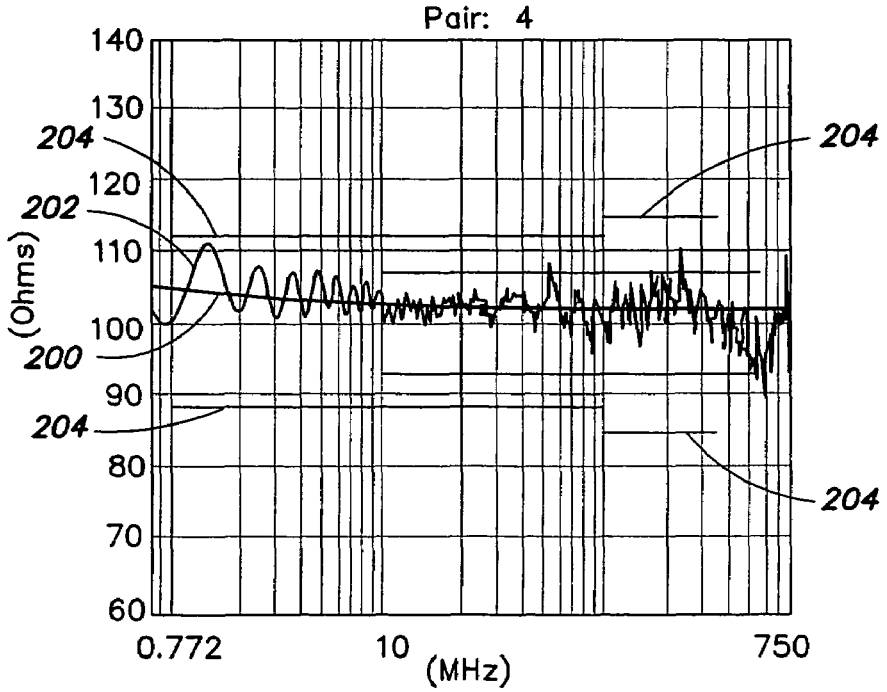
Figure 4A:
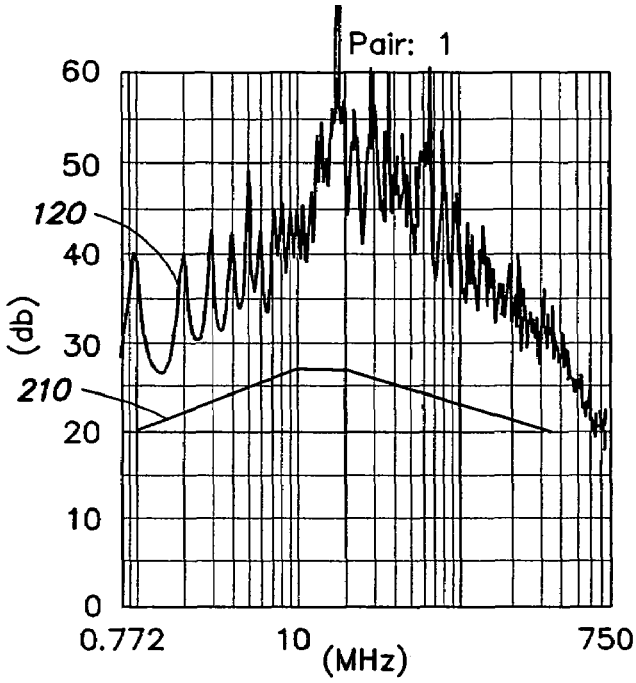
FIGS. 4A-4D are graphs illustrating return loss versus frequency for the same twisted pairs as in FIGS. 3A-3D.
Figure 4B:
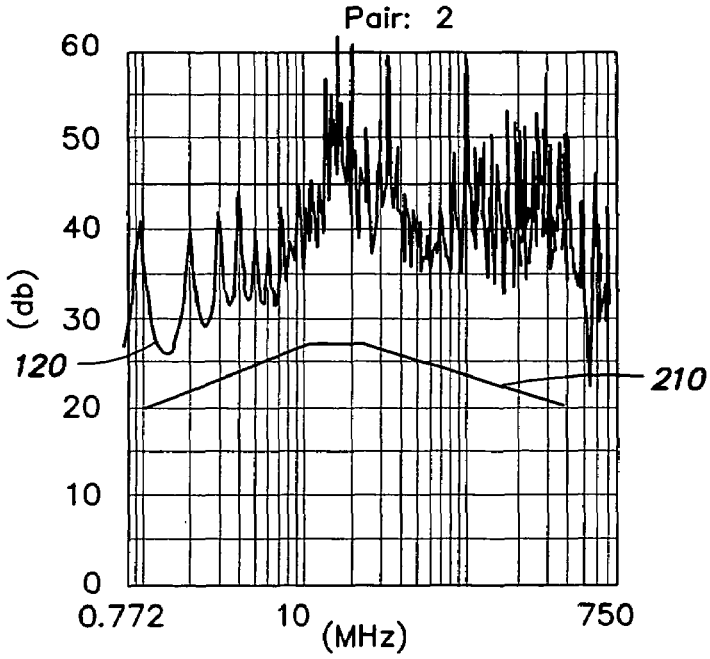
Figure 4C:
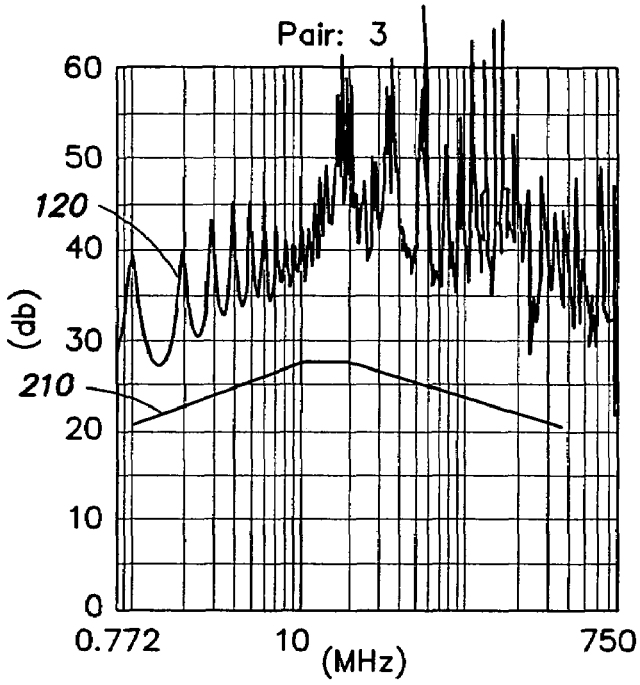
Figure 4D:
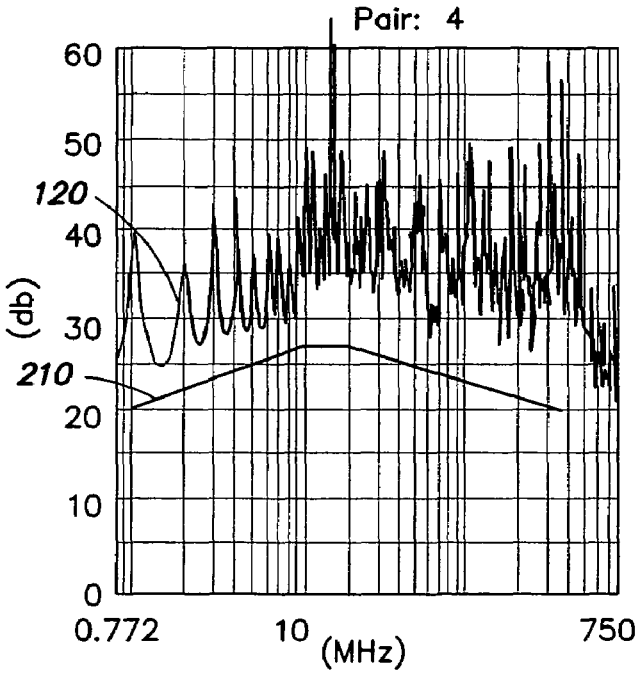

Referring to FIG. 2, there is illustrated a cross-sectional view of one example of a twisted pair of insulated conductors. The twisted pair 114 comprises two electrical conductors 116 which may be, for example, metal wires or strands, each surrounded by at least one insulating layer 118. The nominal impedance of a twisted pair 114 may be related to several parameters including the diameter of the conductors 116 of the twisted pairs making up the cable, the center-to-center distance 120 between the conductors of the twisted pairs, which may in turn depend on the thickness of the insulating layers 118 and the dielectric constant of the material used to form the insulating layers 118.

The characteristic impedance of the cable may generally be determined based on a composite of the individual nominal impedances of each of the twisted pairs making up the cable. The nominal characteristic impedance of each twisted pair may be determined by measuring the input impedance of the twisted pair over a range of frequencies, for example, the range of desired operating frequencies for the cable. A curve fit of each of the measured input impedances, for example, for 801 measured points, across the operating frequency range of the cable may then be used to determine a "fitted" nominal characteristic impedance of each twisted pair making up the cable, and thus of the cable as a whole. The TIA/EIA specification for characteristic impedance of a cable is given in terms of this fitted characteristic impedance including an allowable range of deviation. For example, the specification for a category 5 or 6,100

Ohm cable is 100 Ohms, +/−15 Ohms for frequencies between 100 and 350 MHz and 100 Ohms +/−12 Ohms for frequencies below 100 MHz.

In conventional cables, it is common to design the twisted pair to have a nominal input impedance as close as possible to the specified overall nominal input impedance of the cable. By contrast, Applicant has identified that a reduction in the skew of a cable can be obtained by optimizing the insulation thicknesses to specific pair lays and, in this optimization procedure, allowing an increased deviation of the nominal impedances of the twisted pairs relative to the specified characteristic impedance value for the cable. An advantage of selecting this trade-off is that reduced skew can be obtained while still achieving an acceptable impedance variation and return loss for the cable.

As stated above, the specification for the characteristic impedance of a category 5 or category 6, 100 Ohm cable allows a maximum deviation from the specified 100 Ohm impedance value of +/−15 Ohms for operating frequencies between 100 and 350 MHz and +/−12 Ohms for operating frequencies below 100 MHz. However, conventionally, cable manufacturers have attempted to ensure that each twisted pair has a nominal impedance within +/−2 Ohms of the specified characteristic impedance of the cable. Modern manufacturing includes computerized real-time process controls, latest-technology equipment and improved raw materials, allowing for greater precision in the manufacturing process. This enhanced precision manufacturing allows for use of more of the 15 Ohm (or 12 Ohm) tolerance range because greater precision reduces the "roughness" of the impedance over the operating frequency range. Allowing greater variation in the nominal impedance of the twisted pairs may allow optimization, or variation, of parameters affecting characteristic impedance, to improve other performance characteristics of the cable, such as, for example, the skew of the cable. One example of a machine that may be used, in combination with a standard extrusion machine, to achieve improved manufacturing precision is a Beta Laser-Mike Model 1000 parameter measuring machine. This machine may be used to measure cable parameters during manufacture of the cable and information provided by the machine can be sued to extrude twisted pairs with tighter tolerances.

Referring to Table 1 below, there is given exemplary twist lay lengths for each twisted pair in one example of a four-pair cable. A conventional cable (including four twisted pairs having the twist lay lengths given in Table 1) designed to have characteristic impedance of about 100 Ohms and using like insulation materials and thicknesses on each conductor of the four twisted pairs, may typically have a skew of about 25 nanoseconds (ns) per 100 meters (m) for faster insulations (for example, FEP@0.69 c), and about 30 ns/100 m for slower insulation (e.g., polyethylene@0.66 c). Conventionally, the insulation thicknesses would be selected (as shown in Table 1) to achieve an impedance variation of about +/−1 to 2 Ohms among the twisted pairs.

TABLE 1

| Twisted Pair | Twist Lay Length (inches) | Conventional Insulation Thickness (inches) | Characteristic Impedance (Ohms) |
|---|---|---|---|
| 1 | 0.504 | 0.043 | 100 ± 2 |
| 2 | 0.744 | 0.039 | 100 ± 2 |
| 3 | 0.543 | 0.043 | 100 ± 2 |
| 4 | 0.898 | 0.039 | 100 ± 2 |

Applicant has recognized that by optimizing the insulation thicknesses relative to the twist lays of each twisted pair in the cable, the skew of a cable can be substantially reduced. Although varying the insulation thicknesses may cause variation in the characteristic impedance values of the twisted pairs, under improved manufacturing processes, impedance roughness over frequency (i.e., variation of the impedance of any one twisted pair over the operating frequency range) can be controlled to be reduced, thus allowing for a design optimized for skew while still meeting the specification for characteristic impedance and return loss.

According to one embodiment, a four-pair cable was designed, using a slower insulation material (e.g., polyethylene) and standard pair lays, where all insulation thicknesses were set to 0.041 inches. The twist lays are given below in Table 2. This cable exhibited a skew reduction of about 8 ns/100 meters (relative to the conventional cable described above—this cable was measured to have a worst case skew of approximately 21 ns, whereas the conventional, impedance-optimized cable exhibits a skew of approximately 30 ns or higher), yet the individual pair impedances were within 0 to 3 Ohms of deviation from the specified characteristic impedance (as shown in Table 2), leaving plenty of room for further impedance deviation, and therefore skew reduction.

TABLE 2

| Twisted Pair | Twist Lay Length (inches) | Thickness of Insulation (inches) | Nominal Impedance |
|---|---|---|---|
| 1 | 0.504 | 0.041 | 100 |
| 2 | 0.744 | 0.041 | 102 |
| 3 | 0.543 | 0.041 | 99 |
| 4 | 0.898 | 0.041 | 103 |

According to another embodiment of the invention, a cable may comprise a plurality of twisted pairs of insulated conductors, wherein twisted pairs with longer pair lays have a relatively higher characteristic impedance and larger insulation thickness, while twisted pairs with shorter pair lays have a relatively lower characteristic impedance and smaller insulation thickness. In this manner, pair lays and insulation thickness may be controlled so as to further reduce the overall skew of the cable. One example of such a cable, using polyethylene insulation is given in Table 3 below. This cable was measured to have a skew of approximately 17 ns.

TABLE 3

| Twisted Pair | Twist Lay Length (inches) | Thickness of Insulation (inches) | Nominal Impedance |
|---|---|---|---|
| 1 | 0.504 | 0.042 | 97 |
| 2 | 0.744 | 0.040 | 103 |
| 3 | 0.543 | 0.041 | 97.5 |
| 4 | 0.898 | 0.040 | 103 |

This concept may be better understood with reference to FIGS. 3A-D and 4A-D which respectively illustrate graphs of measured input impedance versus frequency and return loss versus frequency for the twisted pairs of the four-pair cable described in Table 2. Referring to FIGS. 3 A-D, the "fitted" characteristic impedance, line 200, for each twisted pair (over the operating frequency range) may be determined from the measured input impedance, line 202, over the operating frequency range. Lines 204 indicate the category 5/6 specification range for the input impedance of the twisted pairs. As shown in FIGS. 3A-D, the measured input impedance 202 of each of the twisted pairs 1-4 falls within the specified range (within lines 204) over the entire specified operating frequency range of the cable. As shown in FIGS. 3A-3D, the category 5 or category 6, 100 Ohm cable specification allows a maximum deviation from the specified 100 Ohm impedance value of +/−15 Ohms for operating frequencies between 100 and 350 MHz and +/−12 Ohms for operating frequencies below 100 MHz, shown by the discontinuities 208 in lines 204.

Referring to FIGS. 4 A-D, there are illustrated corresponding return loss versus frequency plots for each of the twisted pairs. The lines 210 indicates the category 5/6 specification for return loss of the twisted pairs over the operating frequency range. As shown in FIGS. 4A-4D, the measured return loss 120 for each of twisted pairs 1-4 is above the specified limit (and thus within specification) over the entire specified operating frequency range of the cable. Thus, the characteristic impedance of at least some of the twisted pairs could be allowed to deviate further from the desired 100 Ohms, if necessary, to reduce further skew. In other words, the twist lays and insulation thicknesses of the twisted pairs may be further varied to reduce the skew of the cable while still meeting the impedance specification.

One aspect of this disclosure is allowing some deviation in the twisted pair characteristic impedances relative to the nominal impedance value to allow for a greater range of insulation thicknesses. Smaller diameters are provided for a given pair lay to result in a lower pair angle and shorter non-twisted pair length. Conversely, larger pair diameters result in a higher pair angles and longer non-twisted pair length. Where a tighter (shorter) pair lay would normally have an insulation thickness of 0.043 inches for 100 Ohms, a diameter of 0.041 inches yields a reduced impedance of about 98 Ohms. Longer pair lays using the same insulation material would normally have a lower insulation thickness of about 0.039 inches for 100 ohms, and a diameter of 0.041 inches can be provided and yield about 103 Ohms. As shown in FIGS. 3A-D and 4A-D, allowing this "target" impedance variation from 100 Ohms does not prevent the twisted pairs, and the cable, from meeting the input impedance specification, but may allow improved skew in the cable.

As discussed above, the many constraints imposed on cable designs by the industry standards and specifications may limit the variety of materials that may be used as insulation for the conductors of the twisted pairs. This may, in turn, limit the accuracy with which the signal phase delay added by each twisted pair may be controlled, or may impose strict tolerances on the twist lays of each twisted pair. Applicants have recognized that by using dual-layer insulation for at least some of the twisted pairs may allow the added signal phase delay to be controlled with better precision, at least in part because the effective dielectric constant of the dual-layer insulation depends upon the dielectric constant of the materials used for each layer and on the ratio of the relative thickness of each layer.

Figure 5:
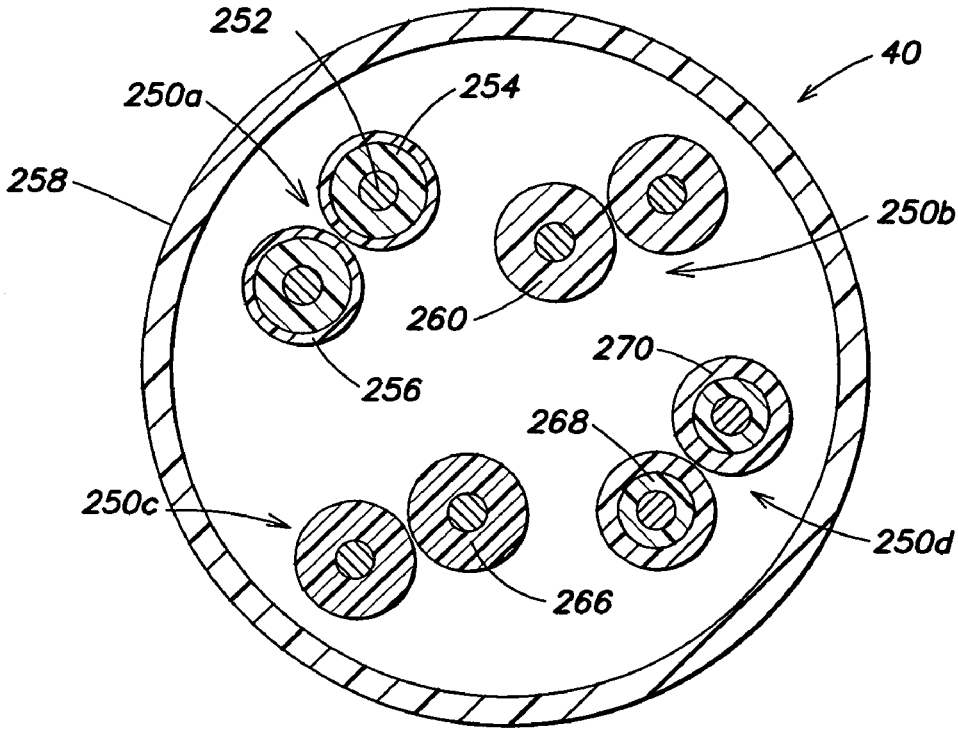
FIG. 5 is a cross-sectional diagram of one embodiment of a twisted pair cable according to aspects of the invention.
Figure 6A:
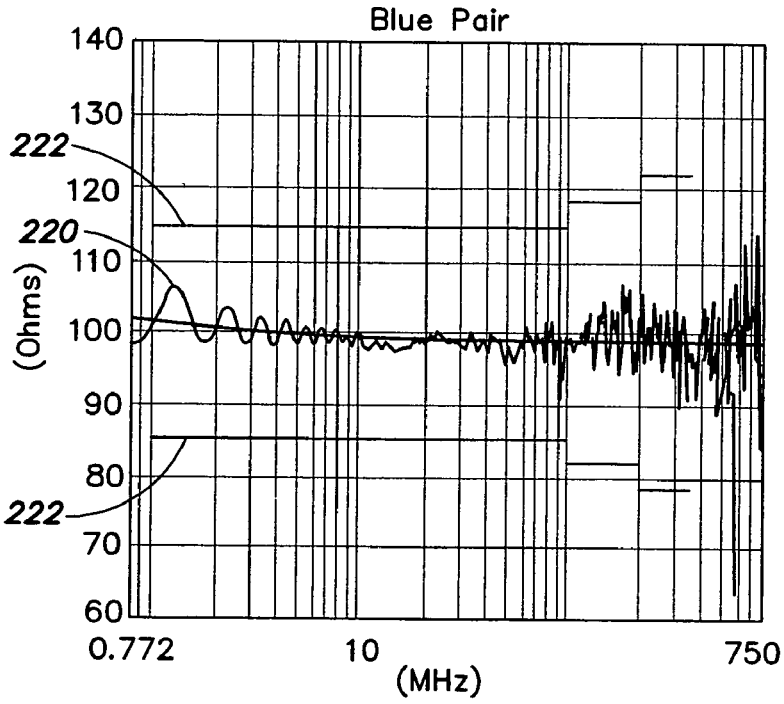
FIGS. 6A-6D are graphs illustrating impedance versus frequency for twisted pairs of one embodiment of a cable.
Figure 6B:
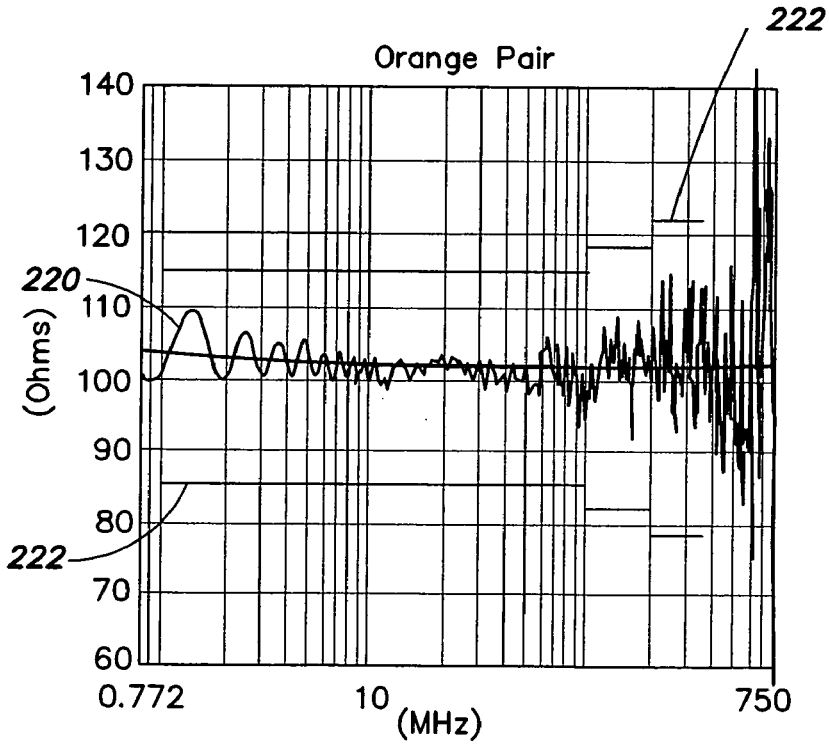
Figure 6C:
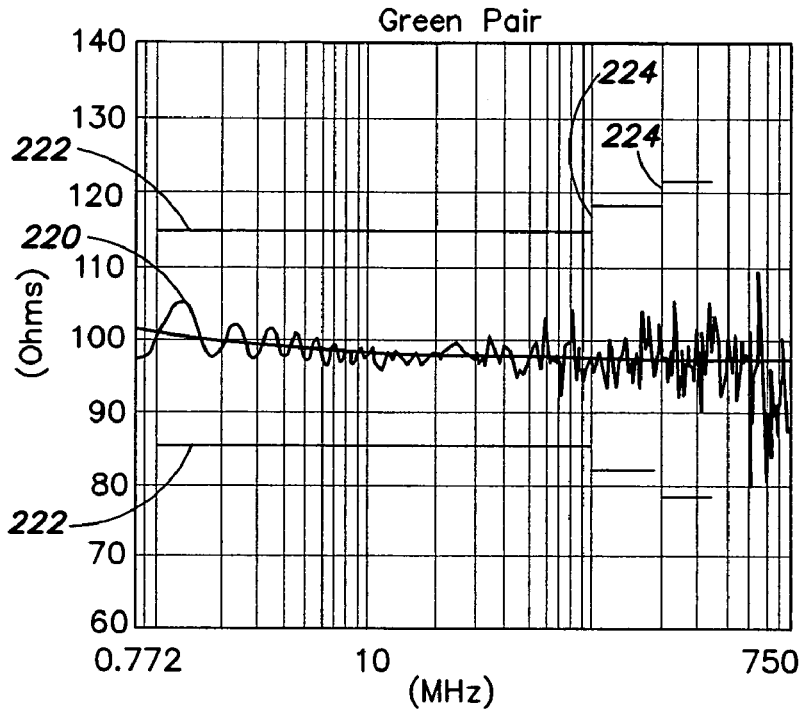
Figure 6D:
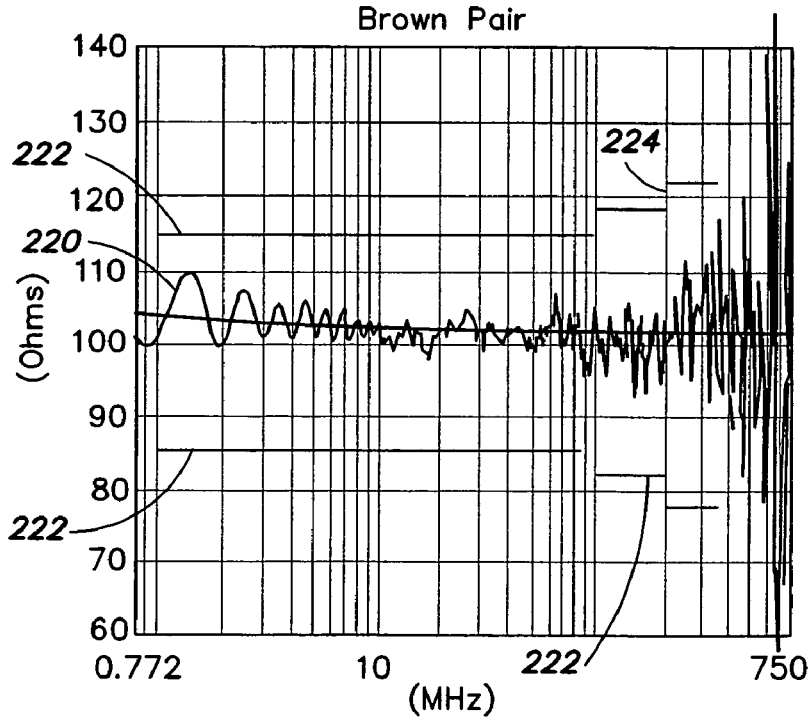
Figure 7A:
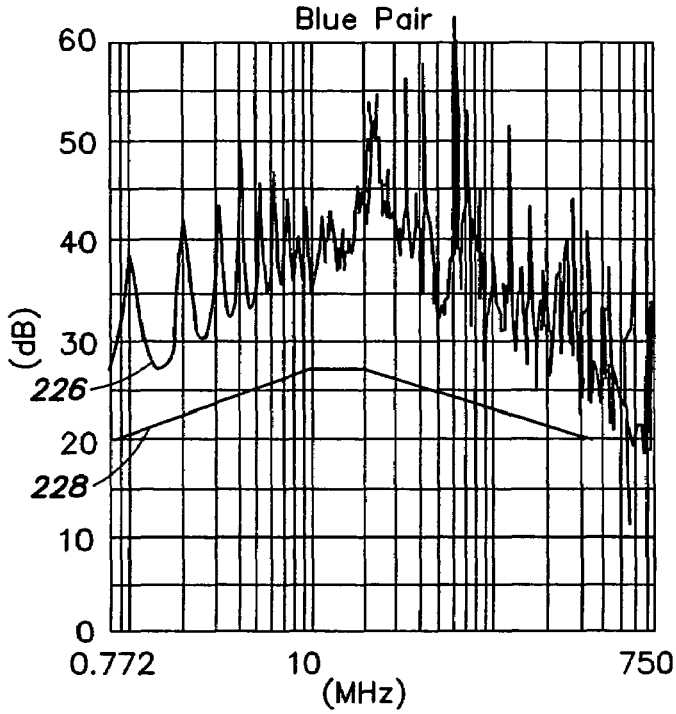
FIGS. 7A-7D are graphs illustrating return loss versus frequency for the same twisted pairs as in FIGS. 6A-6D.
Figure 7B:
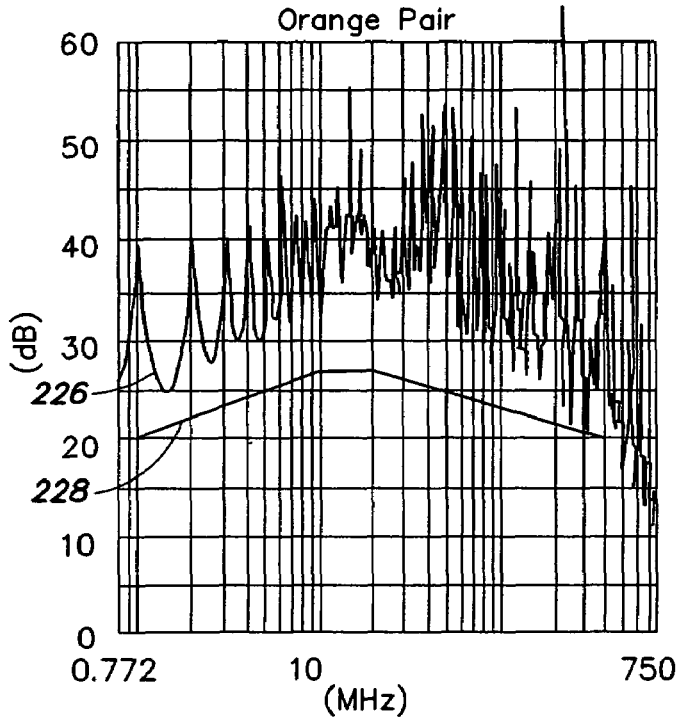
Figure 7C:
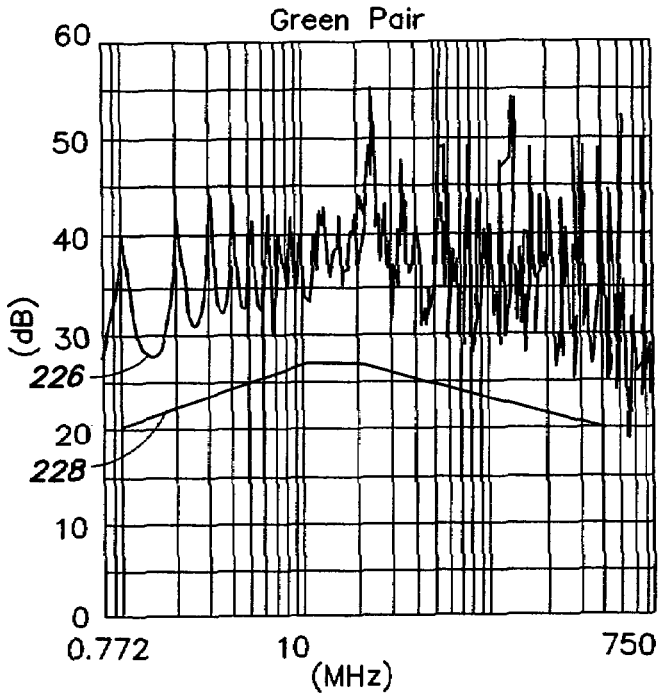
Figure 7D:
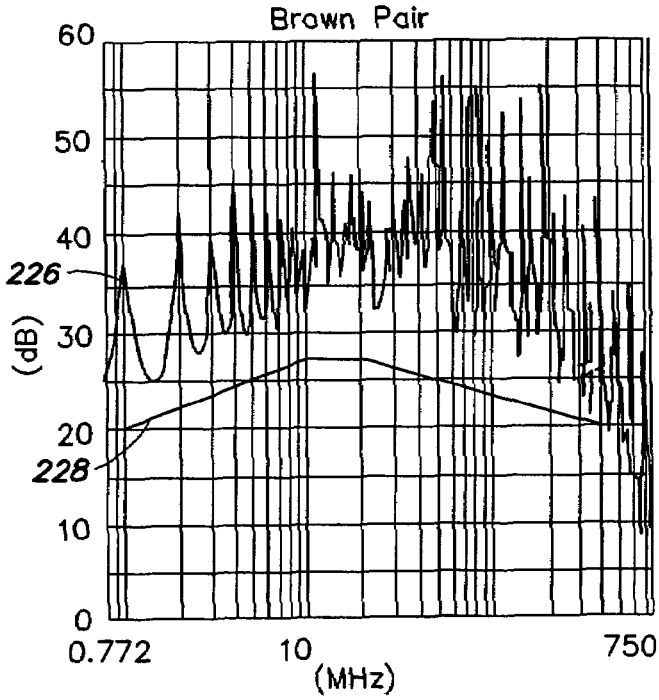

According to one embodiment, illustrated in FIG. 5, the cable 40 may include four twisted pairs of insulated conductors 250*a-d*, each twisted pair including two electrical conductors 252 surrounded by an insulation. The twisted pairs may be surrounded by a jacket 258 to form the cable 40. In one example, two twisted pairs 250*a*, 250*d* may have a dual-layer insulation and two twisted pairs 250*b*, 250*c* may have single-layer insulation. It is to be appreciated that the principles of the invention are not limited to a four pair cable and may be applied to twisted pair cables comprising more or fewer than four twisted pairs of conductors. In addition, although the illustrated example includes two twisted pairs having dual-layer insulation, the invention is not so limited, and one, a plurality or all of the twisted pairs may have dual-layer insulation.

According to one embodiment, the dual-layer insulation of at least one twisted pair, for example, twisted pair 250*a*, may comprise a first insulation layer 254 and a second insulation layer 256. In one example, the first insulation layer 254 may be a polyolefin-based material, such as, for example, polyethylene's, polypropylenes, flame retardant polyethylene, and the like. The second insulation layer 256 may be, for example, FEP or another fluoropolymer. As discussed above, using a fluoropolymer for the outer (second) insulation layer may have advantages in terms of passing the Steiner Tunnel test so that the cable may be plenum rated. However, the invention is not limited to plenum rated cables, and the second insulation layer 256 may also be a non-fluoropolymer. The thicknesses of the first and second insulation layers may be chosen according to factors such as relative cost of the materials and the smoke and flame properties of the materials. The ratio between the thickness of the first insulation layer 254 and the second insulation layer 256 may be selected based on the dielectric constants of the material used for each layer and the desired overall effective dielectric constant for the dual-layer insulation.

Referring again to FIG. 5, at least one twisted pair, for example, twisted pair 250*b*, may comprise a single insulation layer 260 that may be, for example, solid FEP. Table 3 below provides dimensions for one specific example of a four pair cable according to the invention wherein two twisted pairs have a single insulation layer of FEP and the other two twisted pairs have dual-layer insulation, the inner layer being a flame retardant polyethylene and the outer layer being FEP. The worst-case skew (i.e., the largest skew between any two twisted pairs) for this exemplary cable was measured to be approximately 4.45 ns/100 meters.

TABLE 4

| Twisted Pair | Twist Lay Length (inches) | Solid Insulation (FEP) (inches) | 1st Insulation Layer (inches) | 2nd Insulation Layer (inches) |
|---|---|---|---|---|
| Blue (50b) | 0.507 | 0.0385 | — | — |
| Orange (50a) | 0.698 | — | 0.0275 | 0.0368 |
| Green (50c) | 0.543 | 0.0380 | — | — |
| Brown (50d) | 0.776 | — | 0.0275 | 0.0368 |

It is to be appreciated that the above dimensions and specified materials are provided as an example for the purposes of explanation and that the invention is not limited to the specifics examples given herein. In particular, considering the four-pair cable illustrated in FIG. 5, the twisted pair 250*c* may have a single-layer insulation 266 that is not the same material as insulation layer 260 of twisted pair 50*b*. Furthermore, twisted pair 50*d* may have a dual-layer insulation that comprises a first layer 268 and a second layer 270, the thicknesses of which may be different from the thicknesses of the insulation layers 256 and 256 used on twisted pair 50*a*.

Referring to FIGS. 6A-D, there is illustrated measured impedance versus frequency of each of the twisted pairs given in Table 4. The measured impedance is indicated by lines 220. The boundary lines 222 indicate the maximum tolerances (i.e., deviations from the specified 100 Ohms target impedance) allowed by the category 5/6 specifications. Again, the discontinuities 224 in the lines 222 illustrate that the allowed tolerances vary with frequency. As can be seen from FIGS. 6A-D, the measured impedance of each of the twisted pairs falls within the specified tolerances over the specified operating frequency range of the cable. FIGS. 7A-*d* illustrate graphs for each of the twisted pairs of Table 4 showing return loss versus frequency. The return loss for each twisted pair is indicated by lines 226. The category 5/6 return loss specification is indicated by lines 228. As can be seen in FIGS. 7A-D, the measured return loss of each twisted pair meets the category 5/6 specification.

The skew between each twisted pair combination for the above-described cable was measured and is given in Table 5 below. As discussed above, the worst-case skew (i.e., the largest skew between any two twisted pairs) for this exemplary cable was measured to be approximately 4.48 ns/100 meters, illustrating that such a cable can achieve a significant improvement in skew over a conventional cable.

TABLE 5

| Twisted Pair Combination | Measured Skew (ns/100 m) |
|---|---|
| Blue-Orange | 1.67 |
| Blue-Green | 2.65 |
| Blue-Brown | 4.48 |
| Orange-Green | 1.44 |
| Orange-Brown | 2.83 |
| Green-Brown | 1.97 |

Figure 8:
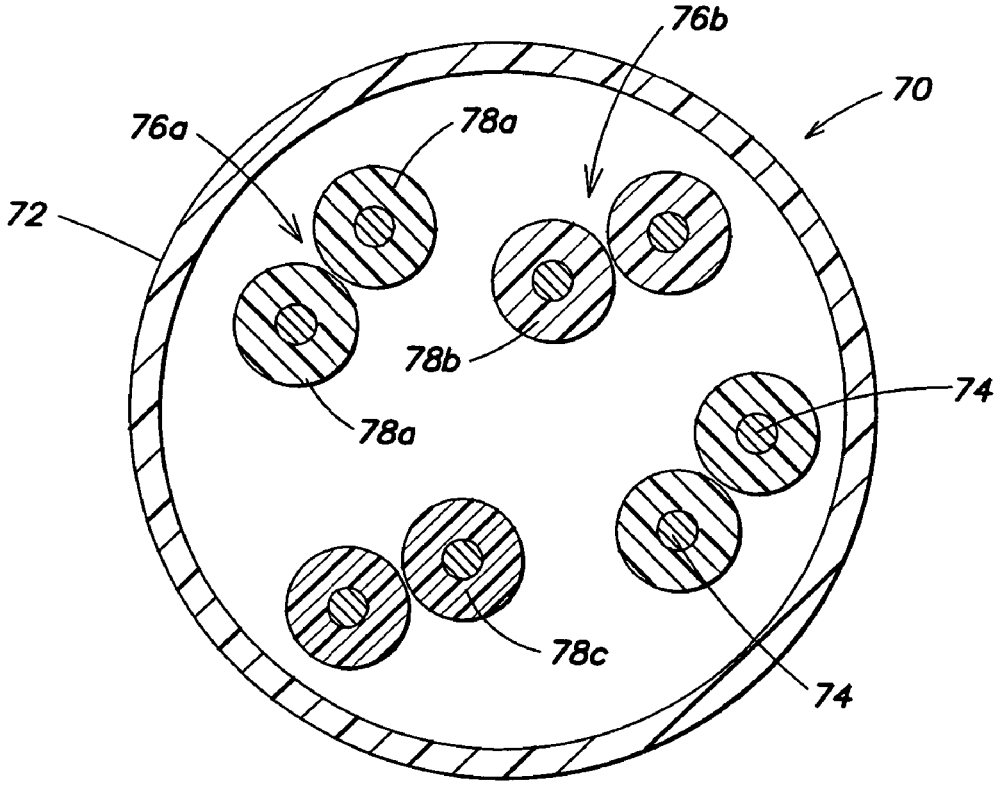
FIG. 8 is a cross-sectional diagram of another embodiment of a twisted pair cable according to aspects of the invention.

Referring to FIG. 8, there is illustrated another embodiment of the invention wherein a cable 70 may comprise a plurality of twisted pairs of insulated conductors surrounded by an outer jacket 72. Each twisted pair comprises two conductive cores 74 each surrounded by an insulation layer. At least one twisted pair 76*a* may have insulation layers 78*a* formed from a material that has a dielectric constant different from that of the material used to form insulation layers 78*b* of another twisted pair 76*b*. The ratio of the dielectric constants of the materials of insulation layers 78*a* and 78*b* may be varied to achieve closely matched signal phases between twisted pairs 76*a* and 76*b* relative to the final twist lays of twisted pairs 76*a* and 76*b*. Preferably, the worst case skew between any twisted pair 76*a* and twisted pair 76*b* may be less than approximately 7 ns/100 meters, and most preferably less than 5 ns/100 meters.

According to another embodiment, the insulation layer for at least one of the plurality of twisted pairs in the cable may comprise an extruded composite insulation layer 78*c*. A plurality of materials may be combined and mixed during the extrusion process to form the single layer composite insulation 78*c*. At least one of the materials used to form the composite insulation 78*c* may have a dielectric constant that is different from the dielectric constant the insulation material on one or more conductors of at least one other twisted pair in the cable.

In one example, the materials that may be mixed to provide the composite insulation may be polyolefins. The ratio of volumes of the various materials used to form the composite insulation may be selected so as to provide a composite insulation having a desired effective dielectric constant and desired effective propagation velocity characteristics. For example, a first material may have a velocity characteristic v1=0.66 c (where c is the speed of light in a vacuum) and a second material may have a velocity characteristic v2=0.68 c. If the first and second materials are mixed in equal quantities, they may yield a composite material having a velocity characteristic vm=0.67 c. Therefore, by controlling the materials used and the ratio of volumes in which they are mixed, a composite material may be formed having a predetermined desired velocity characteristic and effective dielectric constant.

One or more twisted pairs of insulated conductors in a multi-pair cable may use a composite insulation material, as described above, such that a ratio of the effective dielectric constants of the materials relative to another twisted pair within the cable may be varied to achieve closely matched signal velocities relative to the final twist lays of the twisted pairs.

According to one embodiment, a four-pair cable, such as illustrated in FIG. 6, may comprise two twisted pairs having relatively shorter (although not necessarily identical) twist lays and two twisted pairs having relatively longer (although not necessarily identical) twist lays. The insulation used for the two twisted pairs having the shorter twist lays may have a faster velocity characteristic than the insulation used for the two twisted pairs having the longer twist lays. Each insulation may be formed from a composite mixture of materials, mixed in predetermined ratios to obtain the desired velocity characteristics. In other words, the composite insulation materials used on the different twisted pairs may be optimized for the different twist lays such that the skew between any two twisted pairs may be less than approximately 7 ns/100 m and preferably less than 5 ns/100 m.

Table 4 below provides a theoretical example of one embodiment of a four pair cable using composite insulations. The composite insulation is formed from a mixture, in the proportions given in the table below, of a first insulation material having a velocity characteristic of 0.66 c and a second insulation material having a velocity characteristic of 0.61 c. A cable according to this example theoretically has a skew of less than approximately 5 ns/100 m.

TABLE 6

| Twisted Pair | Twist Lay Length (inches) | Composite Insulation Diameter (inches) | 1st Insulation .66c (% of composite) | 2nd Insulation .61c (% of composite) |
|---|---|---|---|---|
| Blue (50b) | 0.507 | 0.040 | 100 | 0 |
| Orange (50a) | 0.698 | 0.0385 | 45 | 065 |
| Green (50c) | 0.543 | 0.0395 | 83 | 17 |
| Brown (50d) | 0.776 | 0.0385 | 0 | 100 |

In one example, a multiple pair cable may comprise a plurality of twisted pairs of insulated conductors, at least one twisted pair having an insulation material that is different from the insulation material of another twisted pair, wherein the insulation thicknesses may be optimized for a skew less than approximately 7 ns/100 meters. In another example, the insulation thicknesses may be optimized for a skew less than approximately 25 ns/100 meters. In yet another example, the insulation thicknesses may be optimized for a characteristic impedance deviation among the twisted pairs of less than about 15 Ohms. By selecting slower of faster dielectrics for the insulation and optimizing the thickness of the selected insulation, the impedance variation between twisted pairs can be reduced for any given desired skew value. For example, a faster insulation material, such as FEP, may allow a twisted pair with a shorter twist lay length to have slightly thicker insulation layer, e.g., about 2 mils thicker, relative to another twisted pair with a longer twist lay length, the two twisted pairs still maintaining desired skew results.

In summary, all parameters, including insulation material, twist lay length and insulation thickness, may be individually adjusted to obtain desired skew and return loss performance.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A cable having a specified characteristic impedance comprising:

a plurality of twisted pairs of insulated conductors designated into a first group of twisted pairs and a second group of twisted pairs;

wherein each twisted pair in the first group of twisted pairs has a first twist lay, a first insulation thickness and a first nominal impedance;

wherein each twisted pair in the second group of twisted pairs has a second twist lay, a second insulation thickness and a second nominal impedance; and wherein a first combination of the first twist lay and the first insulation thickness, and a second combination of the second twist lay and the second insulation thickness are selected such that a difference between the first nominal impedance and the specified characteristic impedance of the cable is greater than about 2 Ohms and less than about 15 Ohms, and a difference between the second nominal impedance and the specified characteristic impedance of the cable is greater than about 2 Ohms and less than about 15 Ohms; and wherein the cable has a skew of less than approximately 25 ns per 100 m.

2. The cable as claimed in claim 1, wherein:

each twisted pair in the first group of twisted pairs has a first insulation material having a first dielectric constant;

each twisted pair in the second group of twisted pairs has a second insulation material having a second dielectric constant greater than the first dielectric constant;

wherein the second twist lay is greater than the first twist lay; and wherein the second insulation material comprises a first layer material having a third dielectric constant and a second layer material, the second layer material being different from the first layer material and having a fourth dielectric constant such that the second dielectric constant is an effective dielectric constant of a combination the first and second layer materials.

3. The cable as claimed in claim 2, wherein the first insulation material is fluoroethylenepropylene.

4. The cable as claimed in claim 2, wherein the first layer material is a polyolefin.

5. The cable as claimed in claim 4, wherein the first layer material is a polyolefin selected from the group consisting of polyethylene, flame retardant polyethylene, and polypropylene.

6. The cable as claimed in claim 4, wherein the second layer material is a fluoropolymer.

7. The cable as claimed in claim 6, wherein the second layer material is fluoroethylenepropylene.

8. The cable as claimed in claim 2, wherein the second layer material is a fluoropolymer.

9. The cable as claimed in claim 8, wherein the second layer material is fluoroethylenepropylene.

10. The cable as claimed in claim 1, wherein the insulation of each twisted pair in the first group of twisted pairs is a composite formed of at least two different polyolefins.

11. The cable as claimed in claim 1, wherein the first and second combinations are selected such that an impedance delta between the first nominal impedance and the second nominal impedance is in a range of about 8 Ohms to 15 Ohms.

* * * * *